United States Patent [19]

Stevens

[11] Patent Number: 5,045,979

[45] Date of Patent: Sep. 3, 1991

[54] SAFETY LIGHT BELT

[76] Inventor: Katrine B. Stevens, 10 Hamilton St., Salem, Mass. 01970

[21] Appl. No.: 600,741

[22] Filed: Oct. 22, 1990

[51] Int. Cl.[5] ..... F21L 15/20

[52] U.S. Cl. ..... 362/108; 362/103; 362/189; 224/224

[58] Field of Search ..... 362/103, 108, 105, 189, 362/200; 224/224, 225, 228, 242, 245, 267, 901; 206/523, 524

[56] References Cited

U.S. PATENT DOCUMENTS

| | | | |
|---|---|---|---|
| 1,217,666 | 2/1917 | Thulin | 362/103 |
| 1,525,374 | 2/1925 | Craig et al. | 362/105 |
| 2,687,835 | 8/1954 | Plonczak | 224/245 |
| 2,889,450 | 6/1959 | Nordquist et al. | 362/200 |
| 4,849,863 | 7/1989 | Gallegos | 362/108 |
| 4,893,221 | 1/1990 | Friedman | 362/108 |

*Primary Examiner*—Ira S. Lazarus
*Assistant Examiner*—Y. Quach
*Attorney, Agent, or Firm*—John P. McGonagle

[57] ABSTRACT

A belt with a holder attached centrally to the belt front. A flashlight is inserted into the holder which is shaped and padded so that the light illuminates an area from one to three feet in front of the belt wearer.

7 Claims, 2 Drawing Sheets

SAFETY LIGHT BELT

BACKGROUND OF THE INVENTION

This invention relates to lighting of the body attached type, and more particularly to a belt with a safety light.

Poor visibility is a serious problem at night for pedestrians, outdoor workers, and outdoor exercisers, such as joggers and the like. The difficulty of maneuvering oneself safely on foot on a roadway, field or yard is well known to walkers, joggers, police officers, firefighters, construction workers, railroad workers, and maintenance men, especially if the person is carrying something or working with their hands.

There have been many attempts to increase pedestrian visibility such as brightly colored and/or reflective clothing. However, little has been done to provide visibility for the pedestrian other than with hand-held flashlights. These are impractical and inconvenient for those wishing to keep their hands free or for use with other tasks.

SUMMARY OF THE INVENTION

In view of the foregoing disadvantages inherent in the known types of devices now present in the prior art, the present invention provides a safety light belt. As such, the general purpose of the present invention, which will be described subsequently in greater detail, is to provide a light, attached to the person, which is aimed in front of the wearer approximately at the point where he or she is about to step.

To attain this, the present invention provides a belt with a light holder mounted on the front thereof. A small light, such as a miniature flashlight, is mounted therein. The holder is so constructed that the light is aimed downward and forward of the belt wearer.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
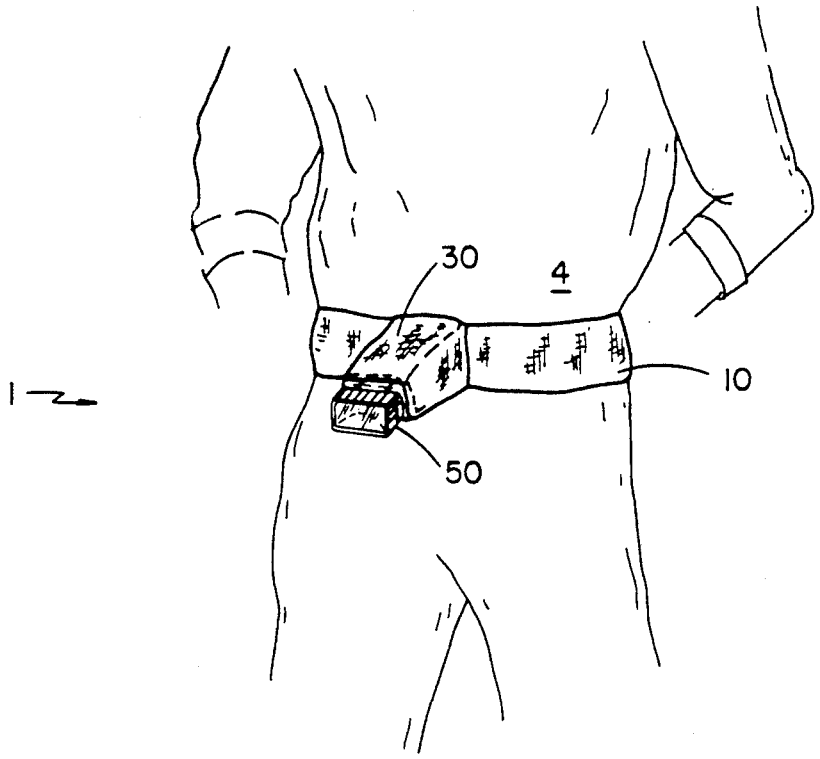
FIG. 1 is a perspective view of a safety light belt incorporating the features of the instant invention.
Figure 2:
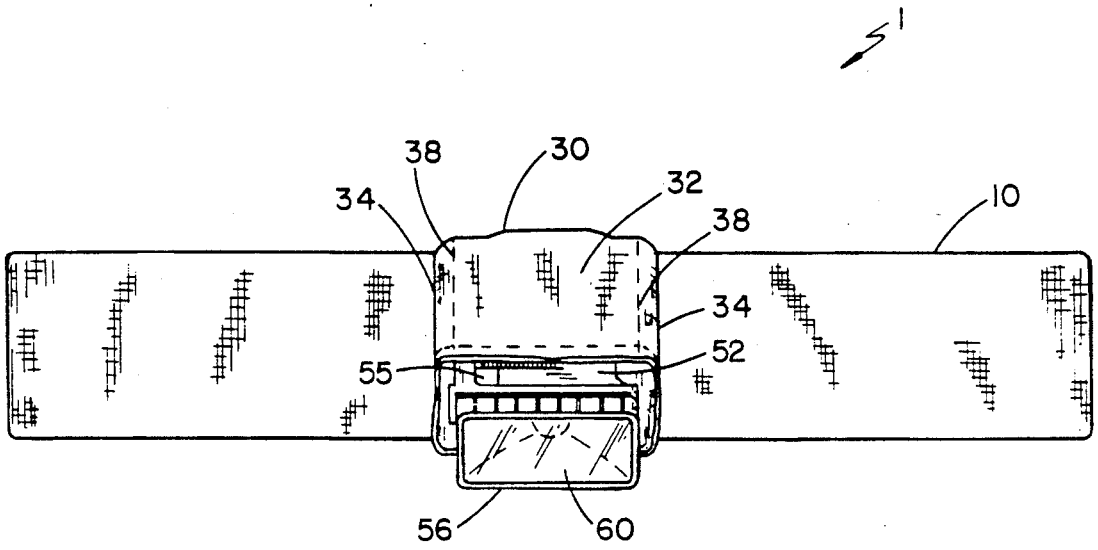
FIG. 2 is a front elevational view thereof.
Figure 3:
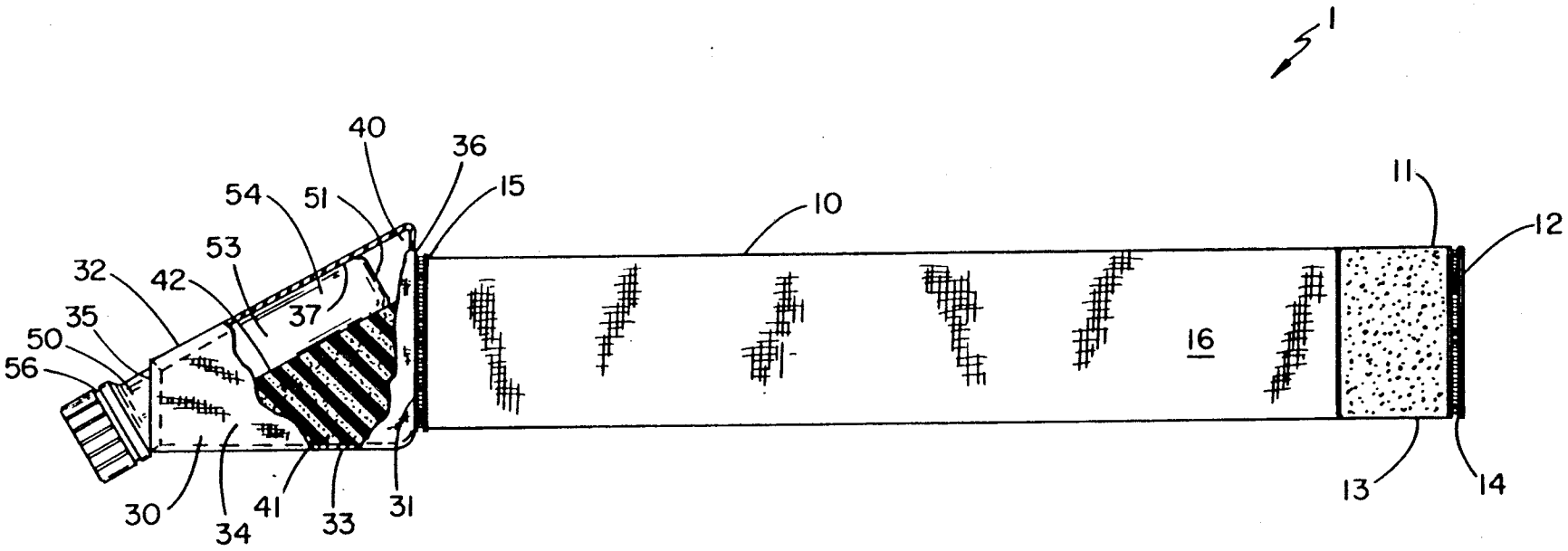
FIG. 3 is a said elevational view partly in section.

Referring to the drawings in detail wherein like elements are indicated by like numerals, there is shown an embodiment of the invention 1 incorporating a safety light belt. The invention 1 is comprised of three elements, i.e., a belt 10, a holder 30, and a light 50. The belt 10 is attached around the trunk 4 of a wearer and has two ends 11 and 12 interconnected with hook and loop fasteners 13 and 14. A hook and loop fastener 15 is positioned centrally on the outside face 16 of the belt 10. The inside belt face (not shown) is the portion of the belt 10 positioned against the wearer's trunk 4. In other embodiments of the invention, this fastener 15 could be positioned elsewhere provided it was on the outside face 16. Other type fasteners may also be used in place of the hook and loop fasteners described above, such as snaps, hooks, buckles, etc. The belt 10 in this embodiment is made of a sturdy "webbing" fabric, but other belt-like materials could also be used.

The holder 30 in this embodiment has a quadrilaterally shaped cross-section. The holder 30 has a back 31, top 32, bottom 33, two sides 34, and an open front 35. The holder back 31 has a hook and loop fastener 36 which joins the holder 30 to the belt 10 by means of the belt central fastener 15. In this embodiment of the invention, the sides 34 are parallel to each other and perpendicular to the planes of the back 31, bottom 33 and top 32. The back 31 and bottom 33 are generally rectangular and form a ninety degree angle. The sides 34 are quadrilateral and form ninety degree angles with the back 31 and bottom 33. The top 32 is generally rectangular and forms an inner angle 40 with the back 31 of a nominal forty-five degrees. The desired inner angle 40 is a function of a wearer's height and will vary with different embodiments, but will generally be an angle of less than ninety degrees.

In this embodiment, the light 50 is battery-powered and has a generally rectangular shape and cross-section. The batteries are contained within the light's housing 54. The light 50 has a top 56 with a bulb 60 and a bottom 51 wherein the light 50 is inserted bottom 51 first into the front opening 35 of the holder 30. The narrower sides 53 of the light housing 54 are parallel to the holder sides 34. The broader faces 52 of the light housing 54 are parallel to the holder top 32. The light's top broad face 55 is attached to the inside 37 of the holder top 32. A pad 41 having a triangular cross-section is positioned inside the holder 30 at the junction of the holder back 31 and bottom 33. The pad's hypotenuse 42 is parallel to the holder top 32. This arrangement of holder 30 and light 50 causes the light 50 to illuminate an area from one to three feet in front of the invention wearer.

The holder 30 in this embodiment is made of a thin fabric and is sewn. A variation of this would be to have the holder top 32 removably fastened along its side edges 38 for access to the light 50 for replacement purposes. It is also desirable to pad the holder top 32 to protect the light 50 inside.

Although the light housing 54 in this embodiment has a rectangular cross-section, it could have a cylindrical shape.

In other embodiments, the holder could be permanently attached to the belt 10 instead of removably attached as in the preferred embodiment.

It is understood that the above-described embodiment is merely illustrative of the application. Other embodiments may be readily devised by those skilled in the art which will embody the principles of the invention and fall within the spirit and scope thereof.

I claim:

1. A safety light belt worn by a person comprising:

a belt having two ends, an outer face and an inner face, said belt having a fastener positioned and attached centrally on its outside face;

a holder attached centrally to the belt outer face, said holder having a back with a fastener attached thereto, a top, bottom, two sides, an open front, and a quadrilaterally shaped cross-section, wherein said holder is attached to said belt fastener by means of said holder back fastener; and a miniature flashlight inserted into said holder and positioned therein so that said miniature flashlight illuminates an area from one to three feet in front of the belt wearer.

2. A safety light belt in accordance with claim 1 wherein:

said belt ends are attached around the trunk of a wearer with fasteners; and said inside belt face is the portion of the belt position against the wearer's trunk.

3. A safety light belt in accordance with claim 2 wherein:

said holder sides are parallel to each other and perpendicular to the planes of the holder back, bottom and top;

said holder back and bottom are generally rectangular and form a ninety degree angle;

said holder sides are quadrilateral and form ninety degree angles with said holder back and bottom; and an intersection between a plane surface of said holder top and a plane surface of said holder back forms an acute angle 4. A safety light belt in accordance with claim 3 wherein:

said flashlight is battery-powered and has a housing with a rectangular shape and cross-section wherein said batteries are contained within said housing.

5. A safety light belt in accordance with claim 4 wherein:

said flashlight has a top with a bulb and a bottom wherein the light is inserted bottom first into the front opening of the holder.

6. A safety light in accordance with claim 5 further comprising:

a pad having a triangular cross-section and positioned inside said holder at the junction of the holder back and bottom, said pad's hypotenuse being parallel to the holder top.

7. A safety light in accordance with claim 6 wherein:

the narrower sides of the said housing are parallel to the holder sides and the broader faces of said housing are parallel to the holder top, and wherein the light's top broad face is attached to the inside of the holder top.

* * * * *